United States Patent [19]

Mueller

[11] 4,256,070

[45] Mar. 17, 1981

[54] VALVE DISABLER WITH IMPROVED ACTUATOR

[75] Inventor: Robert S. Mueller, Birmingham, Mich.

[73] Assignee: Eaton Corporation, Cleveland, Ohio

[21] Appl. No.: 929,159

[22] Filed: Jul. 31, 1978

[51] Int. Cl.[3] ..... F02D 13/06

[52] U.S. Cl. ..... 123/198 F; 123/90.15; 123/90.32; 123/90.41

[58] Field of Search ..... 123/198 F, 90.15, 90.16, 123/90.32, 90.41

[56] References Cited

FOREIGN PATENT DOCUMENTS 2621794 11/1976 Fed. Rep. of Germany ..... 123/198 F
2648799 5/1977 Fed. Rep. of Germany ..... 123/198 F
2725529 4/1978 Fed. Rep. of Germany ..... 123/198 F

*Primary Examiner*—Ira S. Lazarus
*Attorney, Agent, or Firm*—R. J. McCloskey; D. Wood; P. Rulon

[57] ABSTRACT

The actuator disclosed herein uses cyclic forces in a valve gear train of an internal combustion engine to selectively switch a pair of valve disablers between valve enabling and disabling positions. When the disablers are in the valve enabling position, rocker arm fulcrums are latched in a fixed position. When the disablers are in the disabling position, the rocker arm fulcrums are unlatched to allow sliding movement of the fulcrums. The actuator employs a spring which is preloaded to positions for switching the disablers between their enabling and disabling positions in response to movement of the rocker arms which are moved by cyclic forces from a camshaft.

16 Claims, 5 Drawing Figures

VALVE DISABLER WITH IMPROVED ACTUATOR

BACKGROUND OF THE INVENTION

Cross-Reference

This application relates to copending applications Ser. No. 578,295, filed May 15, 1975; and Ser. No. 671,760, filed March 3, 1976 now U.S. Pat. No. 4,222,354. Both of these applications are assigned to the assignee of this application.

FIELD OF THE INVENTION

This application relates to an actuator for disabling a cyclically operated mechanism and more specifically to such an actuator which uses the cyclic forces to switch valve disablers in an internal combustion engine between valve enabling and disabling positions.

DESCRIPTION OF THE PRIOR ART

The above mentioned patent application, Ser. No. 671,760, discloses a pair of valve disablers which are switched between valve enabling and disabling positions by a solenoid which must be relatively large to provide the forces and quickness required to switch the disablers. Such solenoids are expensive to manufacture and operate power-wise. The actuator disclosed herein uses the cyclic forces in the engine valve gear train to provide the large forces and quickness to switch the disablers between the enabling and disabling positions and a relatively small, low power consuming solenoid or other such means to position components in the actuator to effect the switching.

SUMMARY OF THE INVENTION

An object of this invention is to provide an actuator for switching a cyclically operated mechanism between different states of operation.

Another object of this invention is to provide such an actuator which uses the cyclic forces operating the mechanism to switch the mechanism between the states of operation.

Another object of this invention is to provide such an actuator for switching a valve disabler between positions for enabling and disabling a cylinder valve of an internal combustion engine.

According to a feature of the invention, the actuator is combined with an apparatus adapted to switch a mechanism operated by cyclically applied forces between different states of operation; the apparatus includes means moveable between positions for changing the states of operation of the mechanism; the actuator includes actuation means selectively moveable between different positions and operative when in one of the different positions to apply a portion of the cyclically applied force to move the moveable means from one position to another position, and thereby change the state of operation of the mechanism.

BRIEF DESCRIPTION OF THE DRAWINGS

The preferred embodiment of the invention is shown in the accompanying drawings in which.

Figure 1:
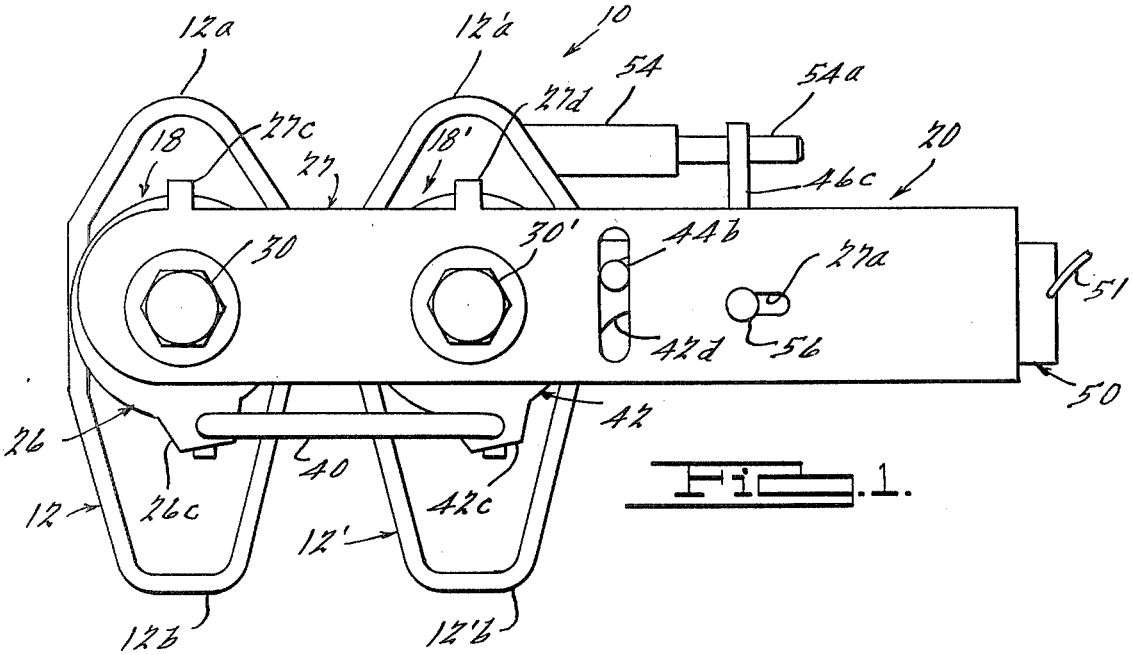
FIG. 1 is a downward looking view of a valve selector and actuator assembly of the invention.

The valve selector and actuator assembly is disclosed for use in an internal combustion engine environment and the description includes certain terminology referring to direction and motion. This environment and terminology is for convenience in describing the assembly and should not be considered limiting unless the claims are explicitly so limited. Further, items in the drawings which are identical in structure and fucntion to other items in the drawings are designated with the same numbers suffixed with a prime.

DETAILED DESCRIPTION OF THE DRAWINGS

Figure 3:
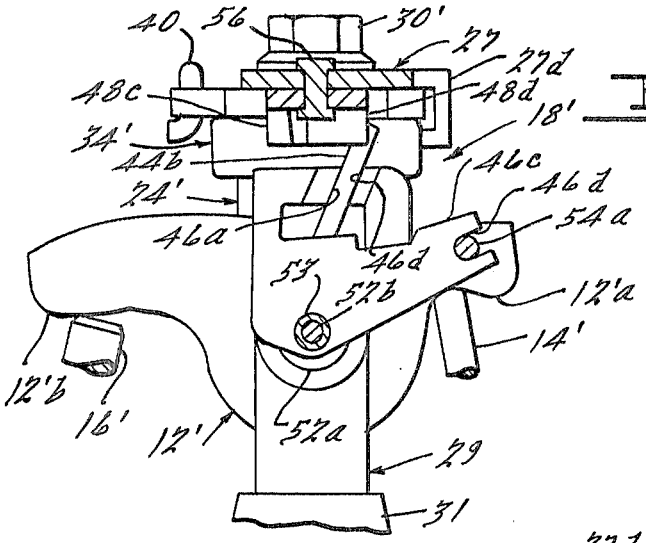
FIG. 3 is a sectional view through the actuator of the assembly looking along line 3—3 of FIG. 2.

The drawings illustrate a valve selector and actuator assembly 10 installed in a portion of an otherwise conventional valve gear train which operates a pair of cylinder valves for one cylinder of a multi-cylinder internal combustion engine. The assembly may be manually or automatically controlled between positions for allowing and preventing normal opening and closing of the valve pair during engine operation. Additional assemblies may be associated with all of the valve pairs in the valve gear train or with only the odd or even numbered valve pairs in the engine firing order. The valve gear train is of the well known type having centrally pivoted rocker arms which pivot about individually supported fulcrums, which each act at one end on a cylinder valve biased to its closed position by a preloaded valve spring, and which are acted upon at the other end by a camshaft driven push rod. The valves open and close in response to cyclic forces caused by the action-reaction between the camshaft and the valve springs. The portion of the valve gear train shown includes a pair of rocker arms 12 and 12' and, as may be seen in FIG. 3, rocker arm 12' is acted upon at one end 12'a by a partially shown push rod 14' and at the other end by a partially shown cylinder valve 16'. Push rod 14' is acted upon by an unshown camshaft and valve 16' is biased upward toward its closed position by a preload valve spring, not shown. As the unshown camshaft rotates, it moves from base circle up on to a lob which moves push rod 14' upward to effect counterclockwise rotation of rocker arm 12' against the force of the unshown valve spring biasing valve 16' closed. As the valve 16' opens, the reaction of the valve spring causes the cyclic force associated with rocker arm 12' to increase. As the camshaft continues to rotate, it comes off of the lob and back on base circle, whereby the valve spring pushes the valve upward toward its closed position and rotates the rocker arm clockwise. The cyclic force decreases or relaxes as the camshaft moves back to base circle.

Assembly 10 includes a pair of valve disablers 18 and 18', which are substantially as disclosed in U.S. Patent Application Ser. No. 671,760, and an actuator 20, which according to the instant invention switches the disablers between valve enabling and disabling positions with forces provided by or generated by the cyclic forces which effect rotation of the rocker arms. Actuator 20 is shown herein in combination with disablers 18 and 18' to teach the inventive features embodied in the actuator. Actuator 20 may be used in combination with a single valve disabler which either totally or partially disables a valve or in combination with any device which is cyclically actuated by cyclic forces.

Disablers 18 and 18' include releaseable fulcrums 22 and 22' which are installed in the valve gear train in lieu of conventional or fixed fulcrums. When the disablers are in their valve enabling positions, fulcrums 22 and 22' are latched to a fixed position, whereby the rocker arms pivot about the fulcrums in response to the cyclic forces to effect normal opening and closing of the valves. When the disablers are in their valve disabling positions, the fulcrums are unlatched, whereby the fulcrums move up and down in response to the cyclic forces to effect a disabling of the valves. During valve disablement, the rocker arms pivot about their respective points of contact with the valves.

Figure 2:
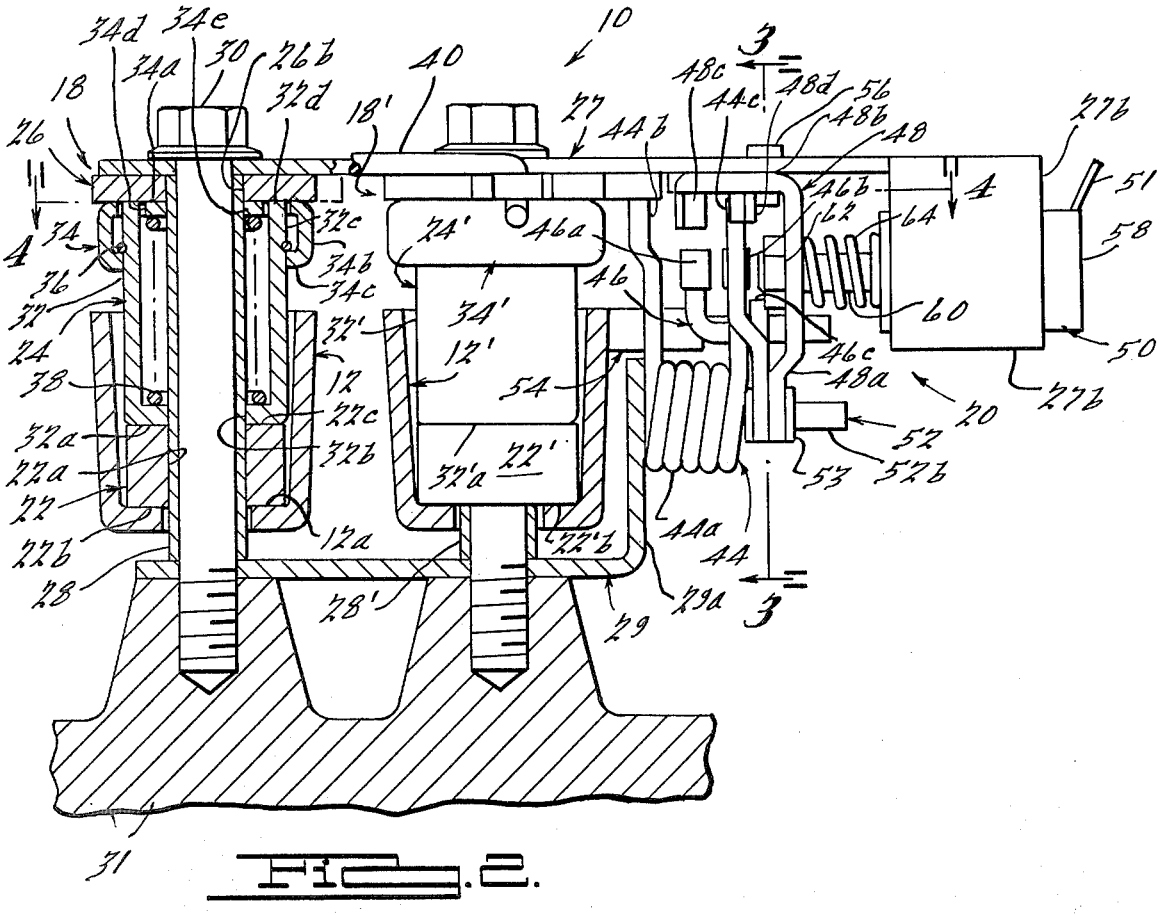
FIG. 2 is an elevational view of the assembly of FIG. 1 in partial section looking along line 2—2 of FIG. 1.

Disablers 18 and 18' are substantially identical in structure and function. Therefore, a detailed description of one will suffice for both. Looking mainly at FIGS. 1 and 2, disabler 18 includes the fulcrum 22, a spring capsule subassembly 24, a latch plate or moveable member 26, a sleeve 28, and a bolt 30. Sleeve 28 is sandwiched between upper and lower support plates 27 and 29 and is rigidly held in place by bolt 30 which passes through the support plates and is threaded into a hole in a valve head structure partially shown at 31. Fulcrum member 22, which may be formed as part of the spring capsule, includes an opening 22*a* which slideably receives sleeve 28, a cylindrical pivot surface 22*b* in contact with a mating surface 12*a* defined by rocker arm 12, and a flat upper surface 22*c*. A hemispherical pivot surface may be used in lieu of the cylindrical pivot surface.

Figure 4:
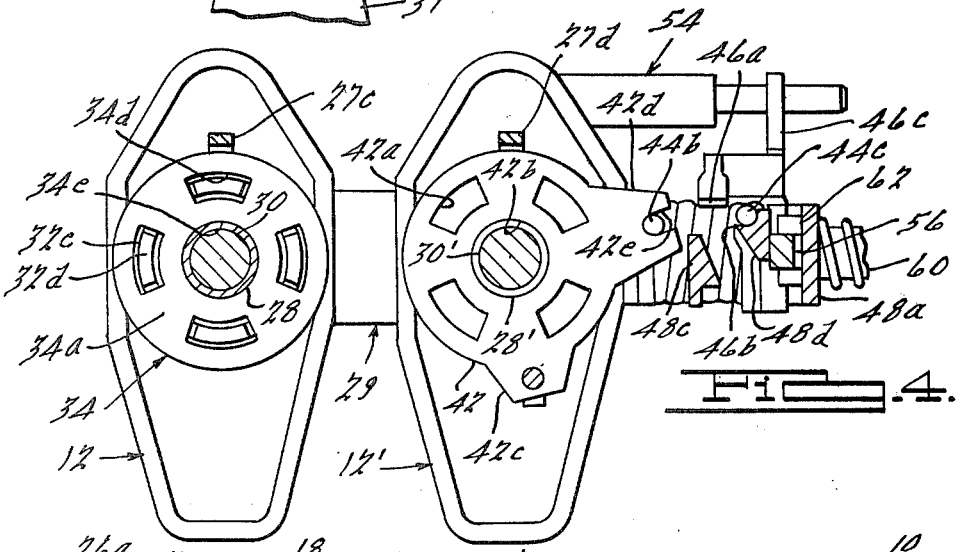
FIG. 4 is a sectional view through the assembly looking along line 4—4 of FIG. 2.

Spring capsule 24 includes a cup-shaped member 32, a cap 34 slideably retained on cup 32 by a snap ring 36, and a helical spring 38 compressed between the bottom 32*a* of the cup 32 and the cap 34. Cup 32 includes an opening 32*b* in bottom 32*a* which slideably receives sleeve 28 and a set of four axially extending teeth 32*c* which each define an upwardly facing abutment surface 32*d*, see FIG. 4. Cap 34 includes a flat plate portion 34*a*, a cylindrical skirt portion 34*b*, and a radially inwardly extending flange portion 34*c* contacting snap ring 36 and defining an opening slideably receiving the side wall of the cup. Flat plate portion 34*a* includes a set of four circumferentially arrayed arcuate openings 34*d*, see FIG. 4, which are in constant slideable receipt of teeth 32*c*, and a central opening 34*e* slideably receiving sleeve 28. Rotation of the spring capsules 24 and 24' relative to upper support plate 27 is prevented by U-shaped tabs 27*c* and 27*d* which extend into an unshown opening in the cylindrical skirt portions of caps 34 and 34' (see FIGS. 1 and 3).

Figure 5:
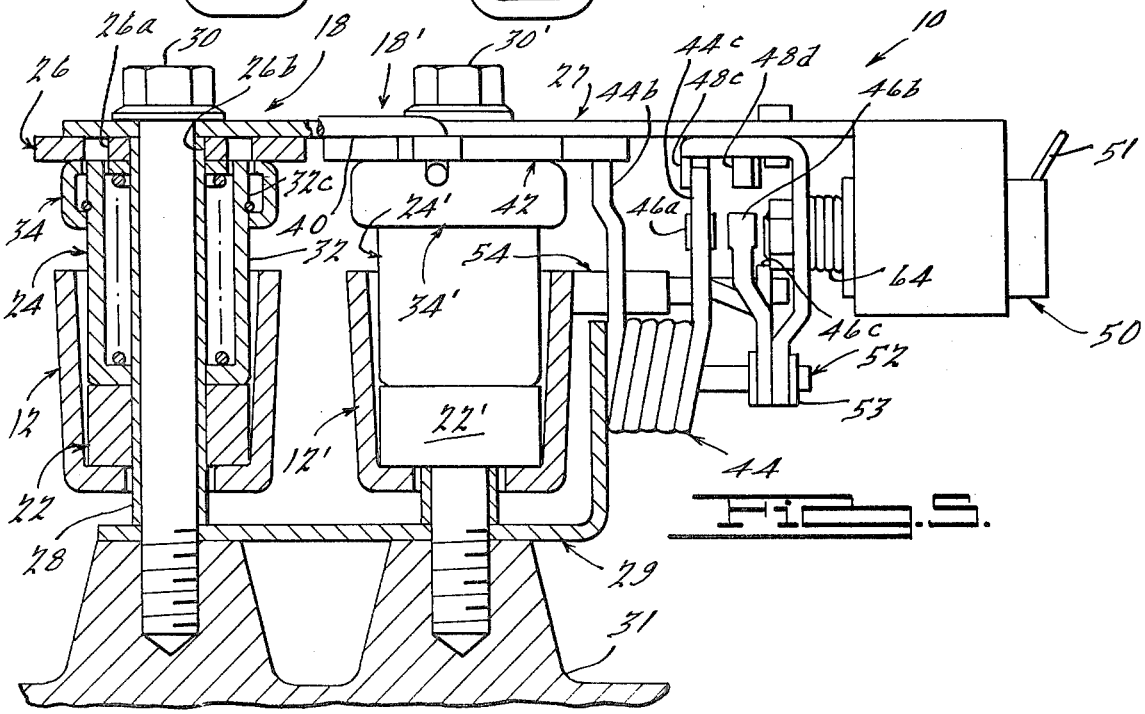
FIG. 5 shows the assembly of FIG. 2 switched to a second position.

Latch plate 26 includes four circumferentially arrayed arcuate openings 26*a*, of which two may be seen in FIG. 5, a central opening 26*b* rotatably supporting the plate about sleeve 28, and a radially extending tab portion 26*c* having a hole therein for receiving one end of a link 40. The other end of link 40 is received in a hole in a tab 42*c* of a latch plate 42 which in disabler 18' is the equivalent of latch plate 26. Looking mainly at FIG. 4, latch plate 42 includes four circumferentially arrayed arcuate openings 42*a* and a central opening 42*b*, as does latch plate 26. Latch plate 42 further includes a second tab 42*d* having a slotted opening 42*e* for connecting the plate to actuator 20. Link 40 pivotally locks latch plates 26 and 42 together. Hence, rotation of latch plate 42 by actuator 20 effects simultaneous rotation of latch plate 26.

Latch plate 26, and likewise latch plate 42, is shown in the valve enabling position in FIGS. 1–4. When latch plate 26 is in the valve enabling position, the portions of the plate between arcuate openings 26*a* are axially aligned with an in abutting contact with the abutment surfaces 32*d* of teeth 32*c*, thereby latching fulcrum 22 in a fixed position and preventing axial movement of cup 32. Latch plate 26, and likewise latch plate 42, is shown in the valve disabling position in FIG. 5. When latch plate 26 is in the valve disabling position, arcuate openings 26*a* are axially aligned with teeth 32*c*, thereby unlatching fulcrum 22 and allowing axial movement of cup 32 against the force of spring 38 in the spring capsule.

The biasing force of spring 38 must be less than the upward biasing force of the unshown valve spring to allow pivotal movement of rocker arm 22 about its point of contact with its associated cylinder valve. However, the biasing force of spring 38 should be great enough to prevent clashing of valve gear train components and ballooning of hydraulic lash adjusters when hydraulic lash adjusters are used.

Actuator 20, as previously mentioned, uses the cyclic forces in the valve gear train to switch the valve disablers between their valve enabling and disabling positions. Actuator 20 includes a torsion spring 44 which is preloaded in opposite directions in response to pivotal movement of rocker arm 12', a cocking member 46 selectively positionable to move spring 44 to either of the preloaded positions, a spring holding member 48 selectively positionable with member 46 to hold spring 44 in either of the preloaded positions, and a solenoid 50 operative when energized and de-energized via a wire 51 to position the cocking member 46 and the spring holding member 48.

Spring 44 includes a coil portion 44*a* wound around a shaft 52, a first tang portion 44*b* connected to latch plate 42 via slot 42*e* and a second tang 44*c*. Shaft 52 includes a large diameter portion 52*a* (see FIG. 3) fixed to a vertically extending flange portion 29*a* of lower support plate 29, and a reduced diameter portion 52*b*. Shaft 52 is preferably in axial alignment with the pivotal axis of rocker arm 12' as defined by fulcrum 22'. Cocking member 46 and spring holding member 48 are retained together for axial movement along the axis of shaft 52 by a flanged bushing 53 slideably supported on shaft portion 52*b*. Cocking member 46 includes a pair of oppositely facing abutment pads 46*a* and 46*b* and a lever portion 46*c* having a slotted opening 46*d* (see FIG. 3) slideably connected to a stepped down portion 54*a* of a shaft 54. Shaft 54 is fixed to the end 12'*a* of rocker arm 12' and pivots cocking member 46 about the axis of shaft 52 in response to up and down movement of rocker arm end 12'*a*. Spring holding member 48 is a substantially L-shaped member having a vertically extending leg 48*a*, which as mentioned is slideably supported at its lower end on shaft portion 52*b*, and a horizontally extending leg 48*b*, which is slideably supported on upper support plate 27 via a rivet 56 extending through an elongated hole 27*a* in the upper support plate (see FIG. 1). Member 48 also includes a pair of oppositely facing spring catches 48*c* and 48*d* which extend downward from the horizontally extending leg 48*b*. Solenoid 50 includes a cylindrical housing 58, which is non-moveably fixed to upper support plate 27 via circular flange portion 27*b* extending therearound, and an armature 60 secured to spring holding member 48 via a nut 62. A spring 64 biases member 48 leftward.

OPERATION

The valves associated with rocker arms 12 and 12' are enabled for normal opening and closing when latch plates 26 and 42 are positioned to prevent axial movement of cups 32 and 32' along the axes of bolts 30 and 30'. When the latch plates are rotated counterclockwise about bolts 30 and 30' to their valve enabling positions, FIGS. 1–4, the rocker arms reciprocatively pivot about fulcrums 22 and 22' to open and close the valves in response to cyclically increasing and relaxing of forces in the valve gear train. When the valves are enabled for normal operation, the cyclic forces are caused by the action-reaction between the unshown camshaft and the valve springs. The valves are disabled from normal opening and closing when the latch plates are positioned to allow axial movement of cups 32 and 32' along the axes of bolts 30 and 30'. When the latch plates are rotated clockwise about bolts 30 and 30' to their valve disabling positions, FIG. 5, the rocker arms reciprocatively pivot about their respective point of contact with the valves in response to the cyclically increasing and relaxing forces in the valve gear train. When the valves are disabled, the cyclic forces are caused by the action-reaction between the camshaft and the springs in the valve disablers.

The latch plates are rotated to their enabling and disabling positions by actuating forces from torsion spring 44 which is preloaded, relative to shaft 52, in either a clockwise direction for rotating the latch plates to their enabling positions or a counterclockwise direction for rotating the latch plates to their disabling positions. The actuating forces are preferably of low magnitudes which are ineffective to move the latch plates when either of the rocker arms are in a rocking mode, that is when the unshown camshaft is not on base circle relative to either of the rocker arms. Hence, the actuation force of spring 44 tending to rotate the latch plates must be less than the abutment forces between the teeth of cups 32 and 32' and the latch plates.

Tang **44*b* of spring 44 is preloaded clockwise to a position for rotating the latch plates to their enabling positions when solenoid 50 is de-energized. When solenoid 50 is de-energized, spring 64 biases cocking member 46 and spring holding member 48 leftward to a position wherein spring tang 44*c*, abutment pad 46*b*, and spring catch 48*d* disposed in a common plane. When so disposed, abutment pad 46*b* contacts tang 44*c* during downward movement of rocker arm end 12'*a* and pushes the tang clockwise to the position of FIGS. 1–4 wherein it is held by catch 48*d*. When tang 44*c* is held by catch 48*d*, tang 44*b* is preloaded in the clockwise direction for rotating the latch plates to their valve enabling position of FIGS. 1–4 following relaxation of the cyclic forces acting on rocker arms 12 and 12'**.

In an analogous manner, tang **44*b* is preloaded counterclockwise to a position for rotating the latch plates to their disabling positions when solenoid 50 is energized. When the solenoid is energized, armature 60 pulls cocking member 46 and spring holding member 48 rightward to a position wherein spring tang 44*c*, abutment pad 46*a*, and spring catch 48*c* are disposed in a common plane. When so disposed, abutment pad 46*a* contacts tang 44*c* during upward movement of rocker arm end 12'*a* and pushes the tang counterclockwise to the position of FIG. 5 wherein it is held by catch 48*c*. When tang 44*c* is held by catch 48*c*, tang 44*b* is preloaded in the counterclockwise direction for rotating the latch plates to their valve enabling positions of FIG. 5 following relaxation of the cyclic forces acting on the rocker arm 12 and 12'**.

A preferred embodiment of the invention has been disclosed for illustration purposes. Many variations and modifications of the disclosed embodiment are believed to be within the spirit of the invention. For example, the latch plates 26 and 42 may be continuously biased to one of the positions in a manner disclosed in the previously mentioned application Ser. No. 671,760 and actuator 20 may be modified to provide actuation forces for moving the latch plates in only the other direction. The following claims are intended to cover the inventive portions of the disclosed embodiment and variations and modifications believed to be within the spirit of the invention.

What is claimed is:

1. In an apparatus adapted to enable and at least partially disable a mechanism normally operated by cyclically applied forces, said apparatus including means movable between two positions for enabling and disabling the normal operation of said mechanism, the improvement of said apparatus comprising;

actuation means shiftable between first and second positions, said actuation means operative when in one of said first and second positions to apply a portion of said cyclically applied forces to said movable means for moving said movable means from one of said two positions to the other of said two positions.

2. The improvement of claim 1, wherein said actuation means is operative in both said first and second positions to apply said force portion to said moveable means for respectively moving said moveable means to said enabling and disabling positions.

3. The improvement of claims 1 or 2, wherein said actuation means includes:

means for limiting said force portion to a level normally ineffective to move said moveable means while said cyclic forces are applied to said mechanism; and means operative to maintain said force portion on said moveable means for effecting movement of said moveable means upon relaxation of said cyclic forces.

4. The improvement of claims 1 or 2, wherein said actuation means includes:

spring means for resiliently transmitting said force portion to said moveable means.

5. The improvement of claim 4, wherein said spring means limits said force portion to a level normally ineffective to move said moveable means while said cyclic forces are applied to said mechanism.

6. The improvement of claims 1 or 2, wherein said actuation means includes:

spring means for transmitting said force portion;

means operative in response to said cyclic forces to move a portion of said spring means to a position resiliently loading said spring means for effecting transmission of said force portion; and means operative to hold said moved portion of said spring in said loaded position for effecting movement of said moveable means by said spring means upon relaxation of said cyclic forces appled to said mechanism.

7. The improvement of claim 6, wherein said spring means is resiliently loaded to a force level normally ineffective to move said moveable means while said cyclic forces are applied to said mechanism.

8. In an internal combustion engine having at least one cylinder valve normally opened and closed in response to cyclically applied forces and an apparatus operative to enable and at least partially disable said valve, said apparatus including means movable between two positions for enabling and disabling the normal opening and closing of said valve, the improvement comprising:

actuation means shiftable between first and second positions, said actuation means operative when in one of said first and second positions to apply a portion of said cyclically applied forces to said movable means for moving said movable means from one of said two positions to the other of said two positions.

9. The improvement of claim 8, wherein said actuation means is operative in both said first and second positions to apply said force portion to said moveable means for respectively moving said moveable means to said enabling and disabling positions.

10. The improvement of claims 8 or 9, wherein said actuation means includes:

means for limiting said force portion to a level normally ineffective to move said moveable means while said cyclic forces are applied to said valve; and means operative to maintain said force portion on said moveable means for effecting movement of said moveable means upon relaxation of said cyclic forces.

11. The improvement of claims 8 or 9, wherein said actuation means includes:

spring means for resiliently transmitting said force portion to said moveable means.

12. The improvement of claim 11, wherein said spring means limits said force portion to a level normally ineffective to move said moveable means while said cyclic forces are applied to said valve.

13. The improvement of claims 8 or 9, wherein said actuation means includes:

spring means for transmitting said force portion;

means operative in response to said cyclic forces to move a portion of said spring means to a position resiliently loading said spring means for effecting transmission of said force portion; and means operative to hold said moved portion of said spring means in said loaded position for effecting novement of said moveable means by said spring means upon relaxation of said cyclic forces applied to said valve.

14. The improvement of claim 13, wherein said spring means is resiliently loaded to a force level normally ineffective to move said moveable means while said cyclic forces are applied to said valve.

15. In an internal combustion engine including at least one cylinder valve; a rocker arm; a fulcrum disposed between the ends of said rocker arm; a latch moveable between a valve enabling position fixing the position of said fulcrum and a valve disabling position releasing said fulcrum for sliding movement; and means operative to apply cyclic forces to said rocker arm, and cyclic forces operative when said latch is in said valve enabling position to pivotally move said rocker arm about said fulcrum for effecting normal opening and closing of said valve and operative when said latch is in said valve disabling position to move said rocker arm and slide said fulcrum; the improvement comprising:

spring means for transmitting a portion of said cyclic forces to said latch for moving said latch from one of said positions to the other of said positions;

means selectively operative in response to movement of said rocker arm by said cyclic forces to move a portion of said spring means to a position resiliently loading said spring means for effecting transmission of said force portion; and means operative to hold said moved portion of said spring means in said loaded position for effecting movement of said latch by said spring means upon relaxation of said cyclic forces applied to said rocker arm.

16. In an internal combustion engine including at least one cylinder valve; a rocker arm; a fulcrum disposed between the ends of said rocker arm; means moveable between a valve enabling position fixing the position of said fulcrum and a valve disabling position releasing said fulcrum for sliding movement; and means operative to apply cyclic forces to said rocker arm, said cyclic forces operative when said moveable means is in said valve enabling position to pivotally move said rocker arm about said fulcrum for effecting normal opening and closing of said valve and operative when said moveable means is in said valve disabling position to move said rocker arm and slide said fulcrum; the improvement comprising:

spring means for transmitting a portion of said cyclic forces to said latch for moving said latch between said enabling and disabling position;

cocking means selectively moveable between first and second positions, said cocking means operative in said first position to load said spring means in a direction for moving said latch to said enabling position in response to movement of said rocker arm by said cyclic forces, and operative in said second position to load said spring means in another direction for moving said latch to said disabling in response to movement of said rocker arm by said cyclic forces; and holding means selectively moveable between first and second positions with said cocking means, said holding means operative in said first and second positions to hold said spring means in either of said loaded directions for effecting movement of said latch to enabling and disabling positions upon relaxation of the cyclic forces applied to said rocker arm.

* * * * *